United States Patent [19]

Guerrier

[11] 4,387,677

[45] Jun. 14, 1983

[54] FUEL, MORE ESPECIALLY AUXILIARY STARTING FUEL, INJECTORS FOR INTERNAL COMBUSTION ENGINES AND TO AUXILIARY CARBURETORS ASSOCIABLE WITH SUCH INJECTORS

[75] Inventor: Jean Guerrier, Nesles la Vallee, France

[73] Assignee: Holt Lloyd S.A., Paris, France

[21] Appl. No.: 276,460

[22] Filed: Jun. 23, 1981

[30] Foreign Application Priority Data

Jun. 24, 1980 [FR] France ..... 80 14039

[51] Int. Cl.[3] ..... F02N 17/00

[52] U.S. Cl. ..... 123/179 L; 123/472; 123/576; 222/402.2; 239/585

[58] Field of Search ..... 123/179 L, 472, 576; 239/585, 88, 91; 222/3, 402.2

[56] References Cited

U.S. PATENT DOCUMENTS

| | | | |
|---|---|---|---|
| 3,418,980 | 12/1968 | Benson | 123/472 |
| 3,567,135 | 3/1971 | Gebert | 239/585 |
| 3,858,771 | 1/1975 | Bret et al. | 222/402.2 |
| 3,966,097 | 6/1976 | Crown et al. | 222/402.2 |
| 4,292,947 | 10/1981 | Tanasawa et al. | 123/472 |

FOREIGN PATENT DOCUMENTS

| | | | |
|---|---|---|---|
| 587864 | 1/1959 | Italy | 222/402.2 |

*Primary Examiner*—Parshotam S. Lall
*Attorney, Agent, or Firm*—Larson and Taylor

[57] ABSTRACT

An auxiliary starting carburetor for internal combustion engines is provided, arranged so as to supply to the engine an auxiliary fuel, particularly in aerosol form. This carburetor comprises: a hollow rod adapted to bear on the valve of the fuel reservoir, an electromagnetic coil for actuating the rod, a chamber provided with a piston for receiving a measured amount of fuel and an outlet connected to the manifold for the fuel expelled by the piston urged by a spring.

5 Claims, 4 Drawing Figures

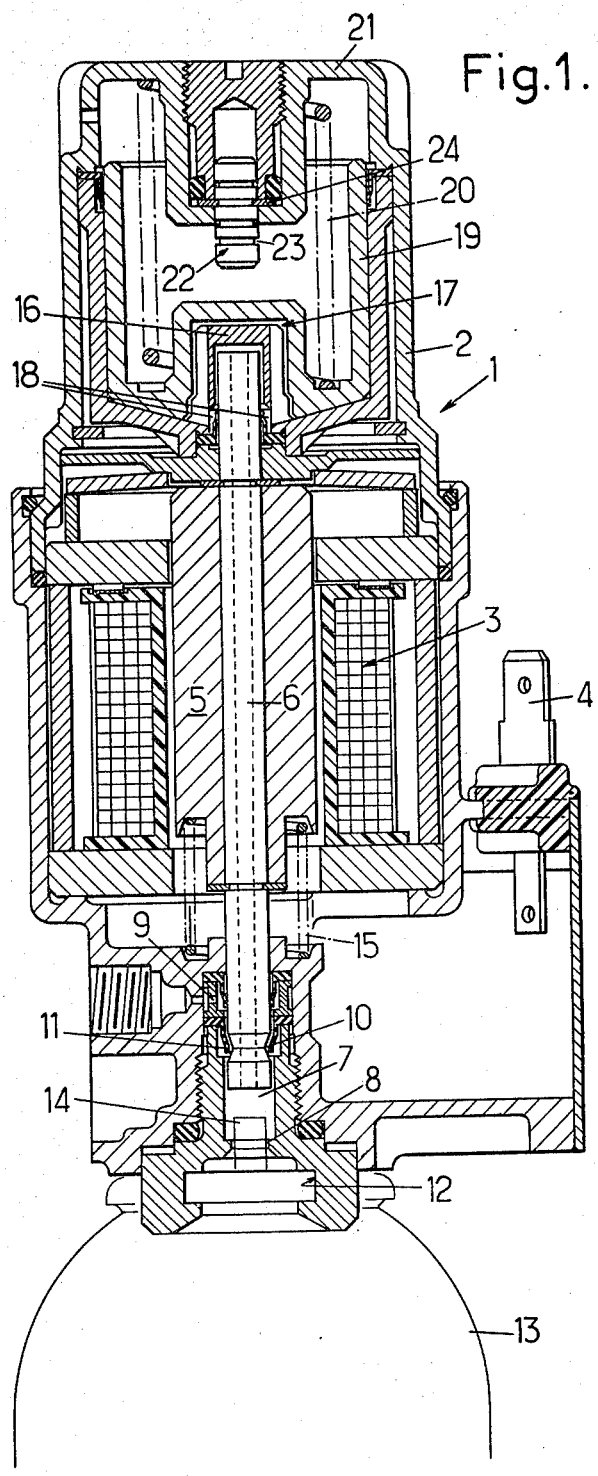
Fig.1.
Fig.3.
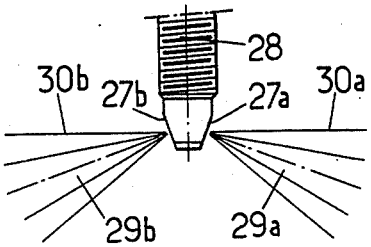
Fig.2.
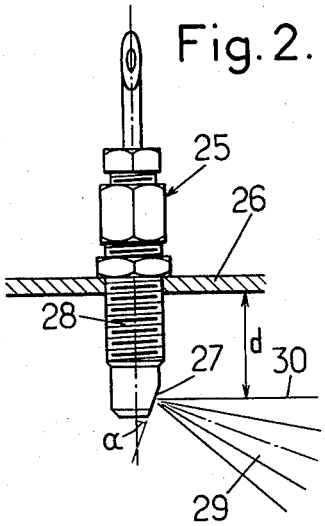
Fig.4.
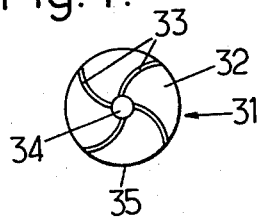

FUEL, MORE ESPECIALLY AUXILIARY STARTING FUEL, INJECTORS FOR INTERNAL COMBUSTION ENGINES AND TO AUXILIARY CARBURETORS ASSOCIABLE WITH SUCH INJECTORS

The present invention relates to improvements made to installations for assisting start-up in internal combustion engines and, more particularly, it relates to improvements made, in such installations, on the one hand, to the fuel injectors for internal combustion engine carburetors, more especially for auxiliary carburetors and, on the other hand, to auxiliary starting carburetors for internal combustion engines, arranged to deliver to the engine, through at least one injector such as those envisaged above, an auxiliary fuel from a reservoir containing said fuel in liquid form with a pressurized gas expellent chemically inert with respect to said liquid fuel (more especially an aerosol), the reservoir having an expulsion port with a back-pressure valve normally maintained in the closed position, said auxiliary carburetor being arranged so that said reservoir is situated at its lower part.

It is normal at the present time to use injectors whose length of penetration inside the intake manifold is all the greater, the larger the engine to be supplied, so as to avoid the projection of atomized fuel on the cold wall of the manifold where it would condense. It is then necessary to manufacture and keep in stock, not only in the production factory but also in workshops for maintaining engines, injectors of different types for equipping respectively engines of different powers.

Moreover, in so far as auxiliary starting carburetors of the above-mentioned type are concerned, several constructions are already known which operate by means of an auxiliary propellent gas.

However, these auxiliary carburetors are relatively space-consuming and, when they are equipped with their removable auxiliary fuel reservoir, they can only be housed with difficulty on board a motor vehicle such as a truck where free space is limited.

Moreover, many known models of auxiliary carburetors, controlled by means of an electromagnetic coil fed from a battery, are not capable of correct operation at very low temperatures (of the order for example of −30° C. to −35° C.) when the power available at the terminals of the battery is too low (only about a third of the power available at normal temperature) for suitably energizing the electro-magnetic coil.

The invention has then essentially as object to improve start-up assisting installations for internal combustion engines so that they answer better than those known up to present the different requirements of the technique.

The invention aims more especially at improving fuel injectors, more especially for auxiliary starting carburetors, so that it is now necessary to manufacture only a single type of injector usable whatever the power of the engine to which it is fitted, so as to obtain substantial economy not only in so far as manufacturing costs are concerned but also in so far as the cost for storing parts for maintenance is concerned.

The invention also aims at improving auxiliary starting carburetors of the above-mentioned kind, intended more especially for supplying improved injectors in accordance with the invention, so that they operate more satisfactorily than in the past, in particular at low temperatures and so that they are more compact than present carburetors, and therefore more easily housable in a motor vehicle such as a truck, for example in or under the dashboard.

To these ends, in a first aspect of the invention, a fuel injector is provided for an internal combustion engine carburetor, more especially for an auxiliary carburetor, and is characterized in that the free end of the injector has at least one cut side and in that an injection port emerges in this cut side, the slope of the cut side with respect to the axis of the injector being such that in operation, the generatrix of the fuel spraying cone, the nearest to the wall of the manifold carrying the injector, is parallel to said wall.

Thus, one can be sure, in normal conditions for supplying the injector, that fuel will no longer be projected and will no longer condense on the cold wall of the manifold, Henceforth, a single type of short injector may be used, which simplifies not only manufacture but also the holding of stocks thereof.

In a preferred embodiment, the injector further comprises deflecting fins for creating swirling spraying of the auxiliary fuel and for improving mixing thereof with the air and ordinary fuel.

Of course, the correct operation of an injector in accordance with the invention requires that the injection pressure of the fuel remain substantially constant during operation.

This condition is fulfilled by associating, with an injector according to the first aspect of the invention, an auxiliary starting carburetor which, in a second aspect of the invention, is characterized in that it comprises in combination and in the order given, from bottom to top of the auxiliary carburetor disposed in its operating position:

a lower chamber in communication with the expulsion port of the reservoir, an outlet port of the auxiliary carburetor communicating with the lower chamber, closure means adapted to selectively close off said outlet port, under the action of control means, a mobile pipe whose lower end emerges into the lower chamber and is arranged to form said means for controlling the closure means, said pipe being adapted to occupy at least two operational positions, namely a first position (rest position) in which its lower end does not cooperate with the back-pressure valve of the reservoir and a second position in which it acts on said back-pressure valve to open the port of the reservoir, an intake port for fuel in the carburetor carried by the lower end of the pipe and adapted to cooperate with the port of the reservoir when the pipe occupies its second operational position, an electromagnetic coil for controlling the movement of the pipe from its first to its second operational position, said coil having a core integral with the pipe which passes therethrough, first return means for returning the pipe from its second to its first operational position when the electromagnetic coil is not energized, a closed enclosure, a piston movable inside said enclosure for defining therein a variable volume upper chamber, into which emerges the upper end of the pipe, a second return means acting on the piston so that the variable volume of the upper chamber is minimum when the carburetor is not operating, the whole of the above-mentioned parts, with the exception of the outlet port of the auxiliary carburetor, being coaxial.

Thus a particularly compact and space-saving auxiliary carburetor is obtained which may be housed in a free space of small dimensions under the engine bonnet, even in or under the dashboard of a motor vehicle such as a truck. In this latter case, the auxiliary carburetor is situated directly within reach of the driver and it is no longer necessary to provide remote actuating means. Furthermore, the replacement of the removable fuel reservoir is facilitated and may be effected more rapidly.

Moreover, the electric power consumption caused by energization of the electromagnetic coil only takes place for filling the chamber, the delivery of the measured amount of fuel being effected solely under the action of the second return means. For this reason, electric power is drawn from the supply battery before the starter motor is actuated to drive the engine. The power drawn from the battery is then spread out in time, which enables an engine to be started even at very low temperatures, when only about a third of the rated power of the battery is available.

Such a mode of operation, particularly advantageous, becomes imperative when the control for starting the engine is arranged so that all the auxiliary electric devices (e.g. headlamps of a vehicle) are switched off when the starter motor is energized.

On the other hand, because the delivery of the measured amount of fuel results from the action of the second return means, the injection pressure of the fuel remains substantially the same at each operation and remains independent of the filling rate of the reservoir.

With these arrangements, the injector(s) constructed in accordance with the first aspect of the invention are optimally supplied and so rapid start-up of the engine is ensured in particularly unfavorable temperature conditions, at the same time avoiding complete discharge of the battery during an extended start-up phase.

In a preferred embodiment, an adjustable stop is provided for limiting the travel of the piston. It is thus possible to provide a single apparatus usable for engines of different powers, the predetermined amount of auxiliary fuel injected at start-up being adjusted with respect to the power of the engine by appropriate adjustment of the stop.

Advantageously, all the seals associated with the moving parts driven by the electro-magnetic coil are lipped seals, which reduces to a minimum the friction opposing movement of the rod, and so the power drawn from the battery. Furthermore, such seals are particularly well suited to equipping apparatus operating under very low temperatures.

The invention will be better understood from reading the following description in which reference is made to the accompanying drawings in which:

FIG. 1 shows, in section, an auxiliary carburetor constructed in accordance with the invention, FIGS. 2 and 3 show two embodiments of injectors in accordance with the invention and FIG. 4 shows, on a larger scale, a detail of the injectors of FIGS. 2 and 3.

As shown in FIG. 1, the auxiliary carburetor 1 of the invention comprises a casing 2 housing, in its central part, an electromagnetic coil 3 connected (in a way not shown) to terminals 4 for connection to an electric supply circuit connected to a DC electric source, generally a battery of accumulators (not shown).

The mobile core 5 of the coil has passing therethrough a hollow rod 6 which is integral with the core and which extends therebeyond on each side.

The lower part of rod 6 is engaged in a housing 7 provided in the casing, which housing has a lower orifice forming the intake port 8 of the carburetor and a lateral orifice forming the outlet port 9 of the carburetor. The outlet port 9 is provided with closure means which comprise, on the one hand, an annular groove 10 formed in rod 6 towards the lower end thereof and, on the other hand, an annular lipped seal 11 surrounding the rod and disposed between the outlet port 9 and the inlet port 8. The respective shapes and dimensions of seal 11 and of groove 10 are such that, in the high position or injection or rest position shown in FIG. 1 (which will be explained subsequently), seal 11 does not bear against the sides of groove 10, the outlet port 9 being then in communication with housing 7. On the other hand, when the rod is completely down (amount measuring position), seal 11 is in abutment against rod 6 and sealingly isolates the outlet port 9 from housing 7.

The inlet port 8 emerges into a cavity 12 arranged to receive the head of the removable reservoir 13 (shown with a phantom line). The reservoir may be secured to the carburetor in any known way.

Reservoir 13 contains an appropriate fuel in liquid form with a pressurized gas expellent chemically inert with respect to the liquid fuel. Advantageously, it may be an aerosol mixture formed by a butane-propane (fuel) and nitrogen (propellent gas) compound.

Reservoir 13 comprises an orifice at its upper part, which is fitted with a back-pressure valve 14 (only the outer part of the actuating finger of which is visible in FIG. 1).

Furthermore, it will be noted that a spring 15, coaxial with rod 6, is placed between the lower end of the core 5 and the part of the casing defining housing 7.

At its upper part, rod 6 is engaged in a bell-shaped part 16 projecting inside a sealed chamber 17 defined by the high parts of casing 2.

The bell-shaped part 16 has openings 18 communicating rod 6 with chamber 17. These openings 18 are situated at the base of the bell-shaped part 16 so that, with the apparatus installed in its vertical operating position, the auxiliary fuel may be expelled in front of the propellent gas.

In chamber 17 there is disposed a piston 19 pushed back, under the action of a spring 20, to a position where the effective volume of chamber 17 is minimum.

In the bottom wall 21 of the casing there is disposed a stop 22 which limits the movement of the piston to a predetermined value. Stop 22 is made adjustable in any appropriate way: in the embodiment shown, the stop is adjustable by jumps. For this purpose, it is constructed in the form of a pin having annular grooves 23 in one of which a locking part 24 is engaged.

Seals are provided at the ends of rod 6 and between the piston and the wall of the chamber: to reduce the friction and minimize the electric power to be drawn from the battery for operating the carburetor, the seals are lipped seals as shown. In addition, such seals, formed for example from "Rilson", continue to fulfil their function at very low temperatures of the order of −30° C. to −35° C., which could not be the case with O-seals.

The operation of the auxiliary carburetor of FIG. 1 is the following.

At rest, the parts occupy the position shown in FIG. 1.

When the electric circuit is closed for supplying electro-magnetic coil 3, the core 5 drives rod 6 towards its lower endmost position (amount measurement position) while compressing spring 15. Rod 6 bears on the actuating finger of the back-pressure valve 14 of reservoir 13 and pressurized mixture passes into housing 7, passes through rod 6 which is hollow and reaches, through openings 18, chamber 17.

Under the force due to the pressure of the mixture, and greater than the force of spring 20, the piston rises in the chamber until it abuts against stop 22.

The time for filling chamber 17 is variable and depends, on the one hand, on the position of stop 22 and, on the other hand, on the pressure of the mixture; by way of example, this time is typically of the order of 2 to 5 seconds.

The user then operates the starter motor of the engine at the same time as he opens the electric energization circuit of coil 3. Core 5 is brought back to its initial position under the action of spring 15 and rod 6 assumes its position shown in FIG. 1. The back-pressure valve 14, which is no longer urged by rod 10, comes back to its closure position and isolates reservoir 13.

With the outlet port 9 again in communication with housing 7, the mixture contained in chamber 17, maintained pressurized under the action of spring 20, is forced towards the outlet port 9, through openings 18, hollow rod 6 and housing 7, and reaches an injector through a pipe connected to port 9 (not shown).

FIG. 2 shows an injector 25 arranged in any appropriate way for fixing on the wall 26 of a manifold. In accordance with the invention, injector 25 is provided, at its free end (lower end in FIG. 2), with a cut side 27 in which opens the injection port and which forms with the axis 28 of the injector an angle $\alpha$ such that, for a given diameter of the injection port and for a given injection pressure, the spraying cone 29 of the auxiliary fuel has a generatrix 30—the one closest to the wall of the manifold (upper generatrix in FIG. 2)—which is parallel to the manifold so as to avoid fuel being sprayed on to wall 26 and there condensing.

FIG. 3 shows another type of injector provided with two sloping sides 27*a* and 27*b* disposes symmetrically with respect to the axis of symmetry 28. Generatrices 30*a* and 30*b* of the spraying cones 29*a* and 29*b* respectively are parallel to the manifold and so approximately aligned.

With the arrangement in accordance with the invention, the projection of the injector into the manifold, i.e. the distance d between the wall of the manifold and the injection port, becomes practically unimportant. It is then possible to use only one and the same type of injector for engines of different powers. In addition, the above-mentioned distance d may be made relatively small so that this auxiliary injector projecting into the manifold, only causes a disturbance of minor importance of the flow of the mixture in normal operation.

It will be noted that the correct operation of the injector of the invention depends essentially on the reproducibility of the operating conditions, i.e. essentially on the injection pressure. The result is that such an injector will prove particularly advantageous in combination with carburetors delivering fuel under an approximately constant pressure, as is the case for the auxiliary carburetor of the invention.

Finally, the injector of the invention may be provided with a deflector system formed, as shown in FIG. 4, by a disk 31, intended to be secured against the inner face of the cut side 27 of FIGS. 2 and 3, and carrying, on its face 32 turned outwardly of the injector, spirally wound walls 33 extending between a central orifice 34 and the peripheral edge 35 of the disk, walls 33 may either be projecting from the disk or, on the contrary, define a groove hollowed out in the disk.

These deflector means create in the fuel injected into the manifold a swirling movement promoting mixing thereof with the air and with the main fuel.

As is evident and as it follows already moreover from what has gone before, the invention is in no wise limited to those of its embodiments and modes of application which have been more especially considered; it embraces, on the contrary, all variations thereof.

I claim:

1. An auxiliary starting carburetor for internal combustion engines, arranged so as to deliver to the engine, through at least one injector, an auxiliary fuel from a reservoir containing said fuel in liquid form and under pressure, the reservoir being removable and having an expulsion port with a back-pressure valve normally maintained in the closed position, said auxiliary carburetor being arranged so that said reservoir is situated at its lower part, an electromagnetic coil being provided for controlling the opening or the shutting of said valve of said expulsion part, characterized in that it comprises the combination of following component parts arranged, respectively from bottom to top of the auxiliary carburetor disposed in its operating position:

a lower chamber in communication with the expulsion port of the reservoir, an outlet port communicating with the lower chamber, closure means adapted to selectively close off said outlet port under the action of control means, a mobile pipe whose lower end opens into the lower chamber and is arranged to form said means for controlling the closure means, said pipe being arranged to occupy at least two operational positions, namely a first position which is a rest position, in which its lower end does not cooperate with the back-pressure valve of the reservoir and a second position in which it acts on said back-pressure valve so as to open the port of the reservoir, a port for the intake of fuel carried by the lower end of the pipe and arranged to cooperate with the port of the reservoir when the pipe occupies its second operational position, said electromagnetic coil for controlling the movement of the pipe from its first to its second operational position, said coil having a core integral with the pipe which passes therethrough, first return means for returning the pipe from its second to its first operational position when the electromagnetic coil is not energized, a closed enclosure, a piston movable inside said enclosure for defining therein an upper variable volume chamber, in which the upper end of the pipe emerges, and second return means acting on the piston so that the variable volume of the upper chamber is at a minimum when the carburetor is not operating, the whole of the above-mentioned component parts, with the exception of the outlet port of the auxiliary carburetor, being coaxially disposed.

2. The auxiliary carburetor as claimed in claim 1, wherein an adjustable stop is provided for limiting the travel of the piston and for regulating the maximum volume of the upper chamber.

3. The auxiliary chamber as claimed in claim 1, wherein the means for closing the outlet port comprise a lipped seal cooperating with the rod; the means for controlling said closure means comprise an annular groove formed in the rod, said groove having a diameter less than the inner diameter of the seal; and the inlet port and the outlet port for the fuel emerge in the lower chamber on each side of said closure means.

4. The auxiliary carburetor as claimed in claim 1, characterized in that all the seals associated with the moving parts are lipped seals.

5. The auxiliary carburetor as claimed in claim 1, characterized in that the upper end of the pipe is covered with a cap which communicates, at its base, with the upper variable volume chamber.

* * * * *